US010251002B2

(12) United States Patent
Salvetti et al.

(10) Patent No.: US 10,251,002 B2
(45) Date of Patent: Apr. 2, 2019

(54) NOISE CHARACTERIZATION AND ATTENUATION USING LINEAR PREDICTIVE CODING

(71) Applicant: Starkey Laboratories, Inc., Eden Prairie, MN (US)

(72) Inventors: Arthur Salvetti, Colorado Springs, CO (US); Martin McKinney, Minneapolis, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 15/076,489

(22) Filed: Mar. 21, 2016

(65) Prior Publication Data

US 2017/0272869 A1 Sep. 21, 2017

(51) Int. Cl.

| | |
|---|---|
| ***H04R 25/00*** | (2006.01) |
| ***G10L 21/0224*** | (2013.01) |
| ***G10L 21/0264*** | (2013.01) |
| ***G10L 25/84*** | (2013.01) |
| *G10L 25/12* | (2013.01) |

(52) U.S. Cl.

CPC ..... *H04R 25/505* (2013.01); *G10L 21/0224* (2013.01); *G10L 21/0264* (2013.01); *G10L 25/84* (2013.01); *G10L 25/12* (2013.01); *H04R 2225/021* (2013.01); *H04R 2225/023* (2013.01); *H04R 2225/025* (2013.01); *H04R 2225/43* (2013.01)

(58) Field of Classification Search

CPC . H04R 25/00; H04R 2225/49; H04R 2460/01

USPC ..... 381/312, 316–318

See application file for complete search history.

(56) References Cited

U.S. PATENT DOCUMENTS 5,233,660 A * 8/1993 Chen ..... G10L 19/08 375/244

5,596,677 A * 1/1997 Jarvinen ..... G10L 19/005 704/220

(Continued)

FOREIGN PATENT DOCUMENTS

| | | | |
|---|---|---|---|
| DE | 102005043314 | A1 | 3/2007 |
| WO | WO-2010083879 | A1 | 7/2010 |
| WO | WO-2014035854 | A1 | 3/2014 |

OTHER PUBLICATIONS

"European Application Serial No. 17161829.1, Extended European Search Report dated Jun. 12, 2017", 9 pgs.

Chalupper, J., et al., "Comparison of Transient Noise Reduction Systems", Practice Management, [Online]. [Accessed Jul. 14, 2017]. Retrieved from the Internet: <URL: http://www.hearingreview.com/2008/01/comparison-of-transient-noise-reduction-systems/>, (Jan. 3, 2008), 8 pgs.

(Continued)

*Primary Examiner* — Suhan Ni

(74) *Attorney, Agent, or Firm* — Schwegman Lundberg & Woessner, P.A.

(57) ABSTRACT

Disclosed herein, among other things, are apparatus and methods for noise characterization and attenuation for hearing assistance devices. In various embodiments, a method of operating a hearing assistance device includes receiving an audio signal using a microphone of the hearing assistance device and identifying a transient in the audio signal. Linear predictive coding (LPC) is used to isolate speech segments and non-speech segments of the transient and fluctuating noise, and the non-speech segments of the transient and fluctuating noise are attenuated to reduce annoyance of the noise and maintain audibility of perceptually important transients in speech.

20 Claims, 4 Drawing Sheets

(56) References Cited

U.S. PATENT DOCUMENTS

| | | | | |
|---|---|---|---|---|
| 5,664,055 | A * | 9/1997 | Kroon | G10L 19/083 704/208 |
| 6,354,299 | B1 * | 3/2002 | Fischell | A61N 1/36025 128/899 |
| 7,440,891 | B1 * | 10/2008 | Shozakai | G10L 15/20 704/233 |
| 8,175,307 | B2 | 5/2012 | Fischer | |
| 8,321,206 | B2 | 11/2012 | Goodwin et al. | |
| 8,526,648 | B2 * | 9/2013 | Dijkstra | H04R 25/407 381/312 |
| 9,247,346 | B2 * | 1/2016 | Kuo | H04R 3/002 |
| 2002/0191799 | A1 * | 12/2002 | Nordqvist | H04R 25/505 381/60 |
| 2007/0269068 | A1 * | 11/2007 | Komagel | H04R 25/453 381/318 |
| 2007/0276660 | A1 | 11/2007 | Pinto | |
| 2010/0049507 | A1 | 2/2010 | Rank et al. | |
| 2013/0132076 | A1 | 5/2013 | Yang et al. | |
| 2015/0189450 | A1 * | 7/2015 | Van Der Werf | H04R 25/453 381/318 |
| 2017/0272869 | A1 * | 9/2017 | Salvetti | H04R 25/505 |

OTHER PUBLICATIONS

Digiovanni, Jeffrey J., "Effects of Transient Noise Reduction Algorithms on Speech Intelligibility and Ratings of Hearing Aid Users", American Journal of Audiology, vol. 20, No. 2, (Dec. 2011), 140-150.

Li, Jian, et al., "Transient Noise Reduction Based on Speech Reconstruction", 21st International Congress on Sound and Vibration, Beijing China, (Jul. 2014), 8 pgs.

Yasuhito, Tademoto, et al., "Transient noise reduction for hearing aid",, 2015 International Symposium on Intelligent Signal Processing and Communication Systems (ISPACS), IEEE,, (Nov. 2015), 66-69.

"European Application Serial No. 17161829.1, Communication Pursuant to Article 94(3) EPC dated Jan. 30, 2019", 7 pgs.

Balaji, Thoshkahna, et al., "A transient detection algorithm for audio using iterative analysis of stft", 12th International Society for Music Information Retrieval Conference, (Jan. 1, 2011).

Bello, J.P. et al., "A tutorial on onset detection in music signals", IEEE Trans. Speech Audio Process., vol. 13, No. 5, (2005), 1035-1047.

* cited by examiner

NOISE CHARACTERIZATION AND ATTENUATION USING LINEAR PREDICTIVE CODING

TECHNICAL FIELD

This document relates generally to hearing assistance systems and more particularly noise characterization and attenuation using linear predictive coding.

BACKGROUND

Hearing assistance devices, such as hearing aids, are used to assist patients suffering hearing loss by transmitting amplified sounds to ear canals. In one example, a hearing aid is worn in and/or around a patient's ear. Sharp transient noises are often perceived as annoying to patients with hearing aids, due to the amplification provided by the hearing aid. While amplification can restore audibility for many hearing-impaired patients it can also cause transients (sharp onsets) of sounds to be annoying to the point of painful. A solution to this problem would soften the perceptual annoyance of transient sounds while maintaining the audibility benefit provided by amplification. Previous solutions include onset detection and attenuation, which help to reduce the annoyance of sharp transients but they also reduce the audibility of perceptually important transients in speech. The previous solutions do not discriminate well between annoying, environmental transients and speech-related transients important for the perception of speech.

There is a need in the art for improved noise characterization and attenuation for hearing assistance devices.

SUMMARY

Disclosed herein, among other things, are apparatus and methods for noise characterization and attenuation for hearing assistance devices. In various embodiments, a method of operating a hearing assistance device includes receiving an audio signal using a microphone of the hearing assistance device and identifying a transient in the audio signal. Linear predictive coding (LPC) is used to isolate speech segments and non-speech segments of the transient, and the non-speech segments of the transient are attenuated to reduce annoyance of sharp transients and maintain audibility of perceptually important transients in speech.

Various aspects of the present subject matter include a hearing assistance device including a microphone configured to receive audio signals, and a processor configured to process the audio signals to correct for a hearing impairment of a wearer. The processor is further configured to identify a transient in the audio signal, use linear predictive coding (LPC) to isolate speech segments and non-speech segments of the transient, and attenuate the non-speech segments of the transient to reduce annoyance of sharp transients and maintain audibility of perceptually important transients in speech.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

BRIEF DESCRIPTION OF THE DRAWINGS

Various embodiments are illustrated by way of example in the figures of the accompanying drawings. Such embodiments are demonstrative and not intended to be exhaustive or exclusive embodiments of the present subject matter.

DETAILED DESCRIPTION

Figure 1:
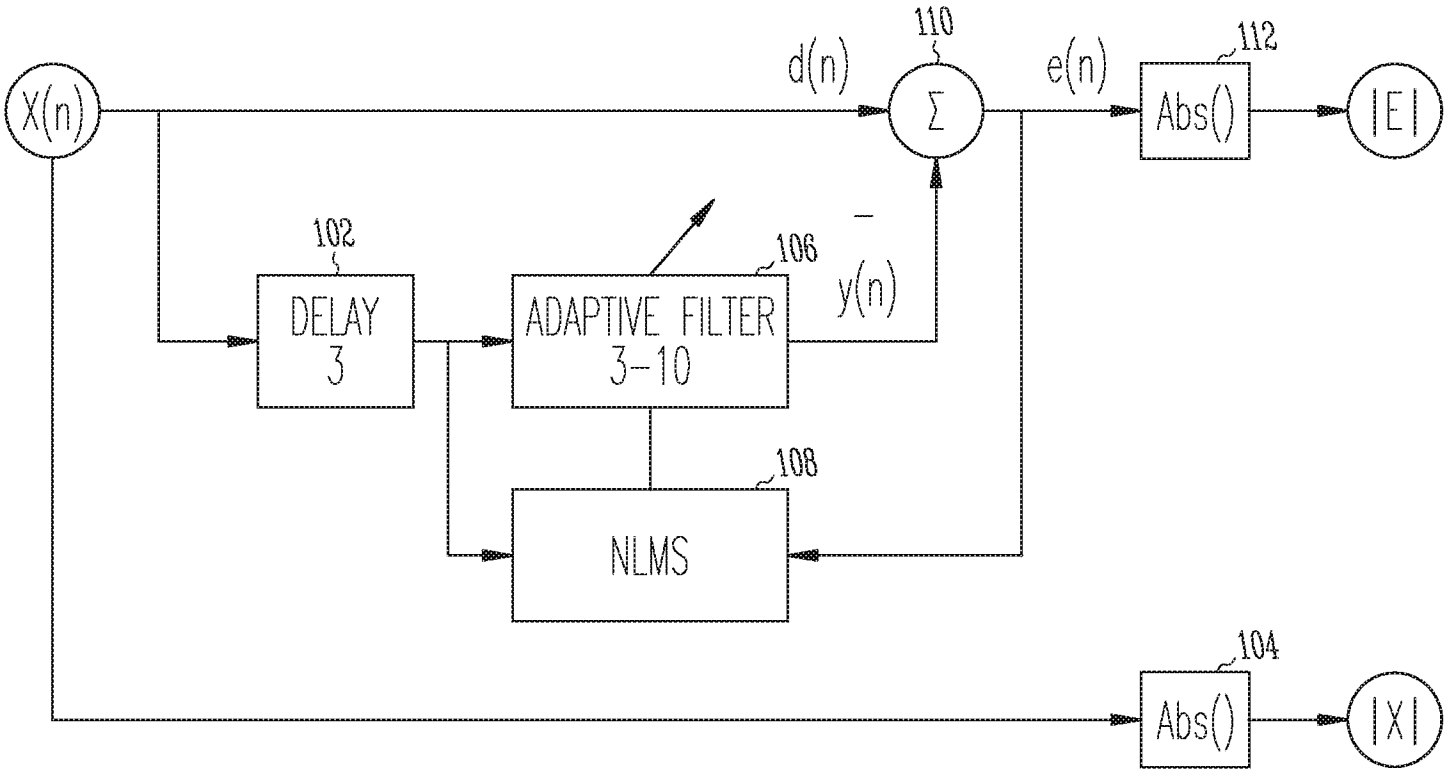
FIG. 1 illustrates a block diagram of a transient detection front end for a hearing assistance device, according to various embodiments of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present detailed description will discuss hearing assistance devices using the example of hearing aids. Hearing aids are only one type of hearing assistance device. Other hearing assistance devices include, but are not limited to, those in this document. It is understood that their use in the description is intended to demonstrate the present subject matter, but not in a limited or exclusive or exhaustive sense.

Sharp transient noises are often perceived as annoying to patients with hearing aids, due to the amplification provided by the hearing aid. While amplification can restore audibility for many hearing-impaired listeners it can also cause transients (sharp onsets) of sounds to be annoying to the point of painful. A solution to this problem would soften the perceptual annoyance of transient sounds while maintaining the audibility benefit provided by amplification. Previous solutions include onset detection and attenuation, which help to reduce the annoyance of sharp transients but they also reduce the audibility of perceptually important transients in speech. The previous solutions do not discriminate well between annoying, environmental transients and speech-related transients important for the perception of speech.

Thus, previous solutions cannot reliably differentiate between noise transients and speech transients and therefore attempt to balance the amount of attenuation so that speech-related transients are left intact while annoying, environmental transients are attenuated. These previous solutions are not completely successful because of the overlapping nature in levels of speech and environmental sounds.

The present subject matter reliably identifies non-speech transients so they can be attenuated without affecting speech transients. Linear predictive coding (LPC) is used to predict whether or not a transient in the acoustic space is part of a speech signal. Speech and non-speech transients are isolated for the purpose of attenuating environment-related annoyance due to transient sounds. In addition, the present subject matter can be used to characterize any environmental sound, and is not limited to transients. For example, the present subject matter can be used to identify and attenuate stochastic, non-periodic sounds, such as rustling plastic bags, frying/cooking noises and running water (all of which are known to cause annoyance for some hearing aid wearers).

Disclosed herein, among other things, are apparatus and methods for noise characterization and attenuation for hearing assistance devices. In various embodiments, a method of operating a hearing assistance device includes receiving an audio signal using a microphone of the hearing assistance device and identifying a transient in the audio signal. Linear predictive coding (LPC) is used to isolate speech segments and non-speech segments of the transient, and the non-speech segments of the transient are attenuated to reduce annoyance of sharp transients and maintain audibility of perceptually important transients in speech. According to various embodiments, the present subject matter uses an error signal from a linear prediction signal model to detect and identify transients.

In various embodiments, LPC includes using an adaptive normalized least means squares (NLMS) filter. A prediction error magnitude is then calculated in various embodiments. A linear finite impulse response (FIR) filter uses past samples to predict a value of a current sample, in an embodiment. In various embodiments, an exponentially smoothed average is computed based on the prediction error magnitude. A dynamic threshold calculation is performed and a detection decision is based on the calculated dynamic threshold and a pre-set threshold value, in various embodiments. An attenuation gain value is set based on instantaneous values of prediction error magnitude, current gain, the pre-set threshold value, and the calculated dynamic threshold, in an embodiment. In one embodiment, a detection decision is based on the calculated dynamic threshold and multiple pre-set threshold values. A sample-and-delay peak tracker is used for transient detection, in various embodiments.

Various aspects of the present subject matter include a hearing assistance device including a microphone configured to receive audio signals, and a processor configured to process the audio signals to correct for a hearing impairment of a wearer. The processor is further configured to identify a transient in the audio signal, use linear predictive coding (LPC) to isolate speech segments and non-speech segments of the transient, and attenuate the non-speech segments of the transient to reduce annoyance of sharp transients and maintain audibility of perceptually important transients in speech.

The present approach uses linear prediction as a front end for detecting transients. Thus, this approach is different from previous methods for transient detection in that it does not use envelope-based processing for detection. Transients are unexpected and unpredictable outbursts of impulsive audio energy than can cause discomfort for the wearer of a hearing aid. On the other hand, speech and music are more predictable, and past samples can be used predict future signals. The present subject matter uses a predictor filter to detect unpredictable signal segments. If these unpredictable signal segments reach considerable amplitude, they are identified and tagged as noise transients, and the reduction of signal amplitude is triggered. There are several possibilities for sophisticated predictor filters and auto-regressive models, however due to computational constraints in hearing aids, the present embodiment uses as the linear predictor an adaptive normalized least mean squares (NLMS) filter. Other types of filters can be used without departing from the scope of the present subject matter. In various embodiments, the present subject matter can use other signal models, such as neural network or sinusoidal models, for example, to detect and identify transients.

FIG. 1 illustrates a block diagram of a transient detection front end for a hearing assistance device, according to various embodiments of the present subject matter. The detection front end operates on the time domain signal x(n), uses a delay 102, an adaptive filter 106, an NLMS filter 108, a summer 110 and two absolute value blocks 104 and 112, and generates two magnitude signals: the signal magnitude |x| and the prediction error magnitude |e|, in various embodiments. The prediction is done using a linear FIR filter which uses past samples to predict the value of the current sample, in an embodiment. In this embodiment, the filter coefficients are constantly calibrated by the NLMS adaptation process, which seeks to minimize the prediction error. In various embodiments, the adaptive filter output is represented by:

$$y(n) = \sum_{k=0}^{N} w_k x(n - \text{delay} - k)$$

The NLMS update is calculated using:

$$w_k(n+1) = w_k(n) = \frac{\mu}{P_x + P_e} e(n) * x(n - \text{delay} - k)$$

Figure 2:
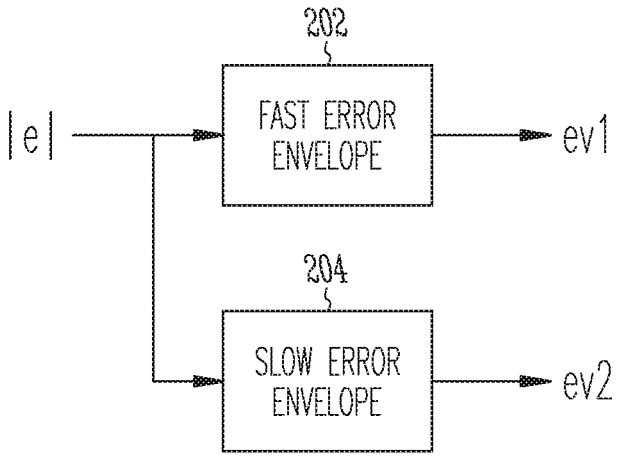
FIG. 2 illustrates a block diagram of a transient detection second stage for a hearing assistance device, according to various embodiments of the present subject matter.

FIG. 2 illustrates a block diagram of a transient detection second stage for a hearing assistance device, according to various embodiments of the present subject matter. In various embodiments, the second stage uses the absolute vales of the signal |x| and prediction error |e| to compute the exponentially smoothed average, which is closely related to the signal envelope. The exponentially smoothed envelope is computed as:

$$ev(n)=(1-\alpha)ev(n-1)+\alpha|x|$$

Depending on the smoothing factor $\alpha$ magnitude, the envelope signal is classified as slow envelope 202 or fast envelope 204, in various embodiments. In one embodiment, valid values for $\alpha$ are $0<\alpha<1$.

Figure 3:
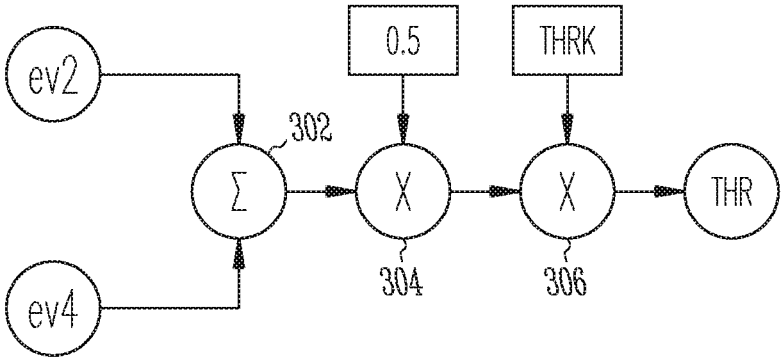
FIG. 3 illustrates a block diagram of dynamic threshold calculation for transient detection in a hearing assistance device, according to various embodiments of the present subject matter.

FIG. 3 illustrates a block diagram of dynamic threshold calculation for a hearing assistance device, according to various embodiments of the present subject matter. The first part of the transient detection block is the dynamic threshold calculation. Based on heuristic rules, the envelope values ev2 and ev4 are used, along with summer 302 and processing blocks 304 and 306, to set a dynamic threshold in an embodiment. The envelope ev4 is a sample-and-decay peak tracker of |x|, such that on any given sample if |x|>ev4, ev4=|x|, otherwise ev4 decays exponentially with a slow time constant, in various embodiments. In various embodiments, the ev4 signal generator can be represented by:

$$|x| \rightarrow [\text{Max Peak Tracker}] \rightarrow ev4$$

Figure 4:
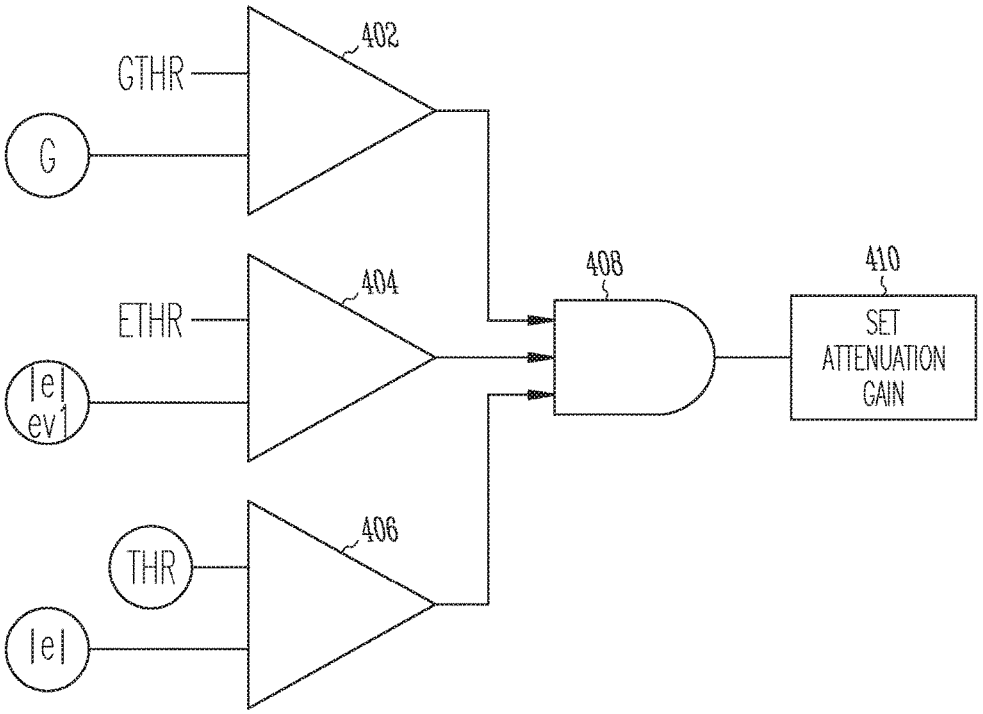
FIG. 4 illustrates a block diagram of a detection decision block for transient detection in a hearing assistance device, according to various embodiments of the present subject matter.

FIG. 4 illustrates a block diagram of a detection decision block for a hearing assistance device, according to various embodiments of the present subject matter. After the threshold is calculated, the detection decision is made. According to various embodiments, the instantaneous value of the magnitude of prediction error |e|, ev1, and the current gain G are compared using logic blocks 402, 404, 406 and 408 to the pre-set threshold values GTHGR and ETHR, as well as the dynamic threshold THR, to define a positive detection and set the attenuation gain value. The attenuation control block 410 is part of the overall transient reduction algorithm. In this embodiment, a gain is applied to the input sample, x(n), as follows:

$$\text{out}(n)=G*x(n),$$

where G is the degree of attenuation. G=1 most of the time, and is set to G<1 when a transient is detected. Maximum attenuation in some hearing aid algorithms is near 20 dB attenuation (G=0.1). In various embodiments, the target attenuation is smoothly set using a fast gain attack time constant, and gently removed using a slower gain release time constant. The amount of attenuation can be modified to control the aggressiveness of the algorithm, in various embodiments.

Figure 5:
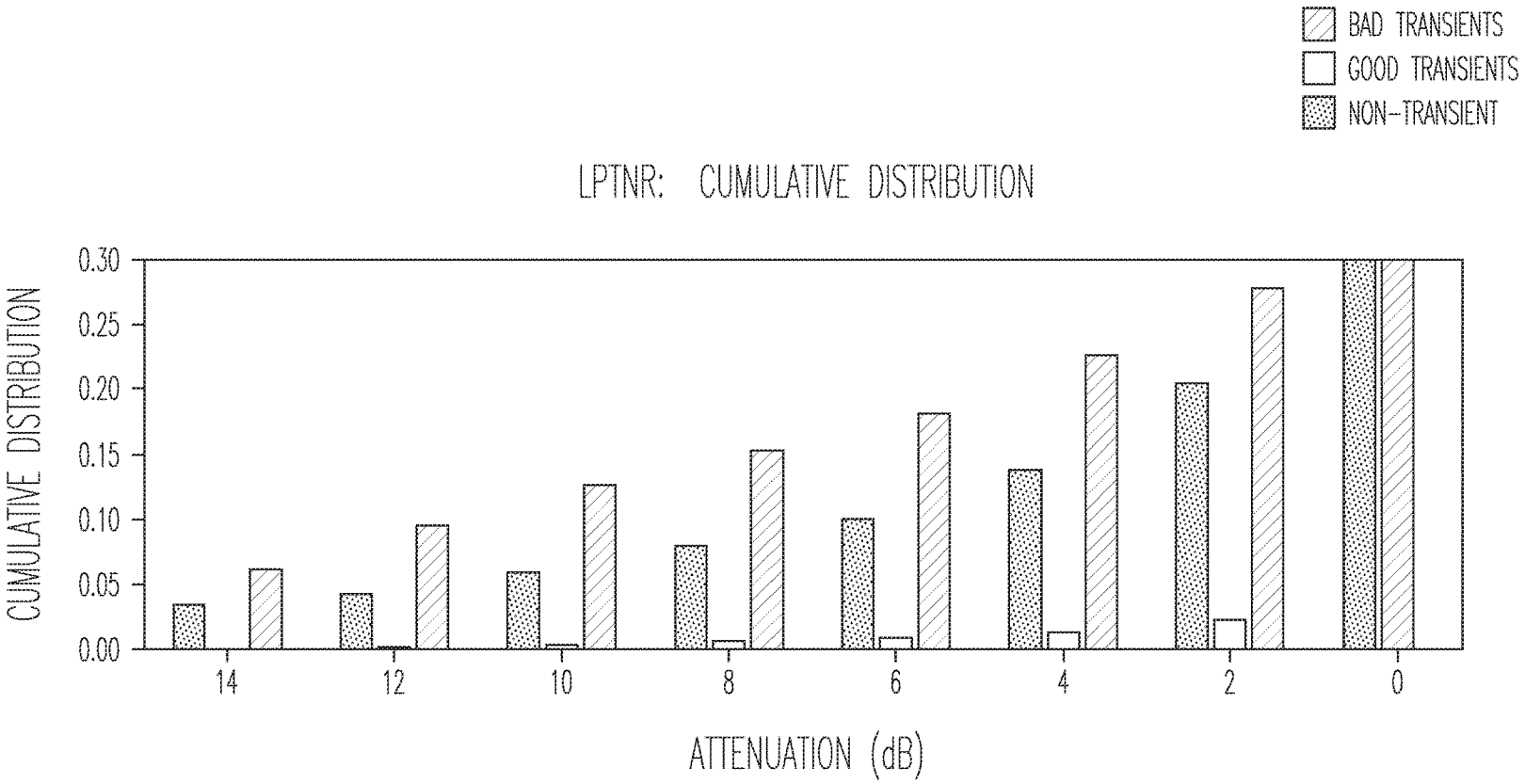
FIG. 5 illustrates attenuation results for transient reduction and suppression, according to various embodiments of the present subject matter.

FIG. 5 illustrates attenuation results for transient reduction and suppression, according to various embodiments of the present subject matter. FIG. 5 illustrates results from the present subject matter using Linear Prediction Transient Noise Reduction (LPTNR), showing that the present subject matter is able to attenuate "bad", i.e. noise, transients to a greater degree while not attenuating "good", i.e. speech, transients. Some non-transient sounds were also attenuated by the present subject matter, but those sounds were noises characterized by random fluctuations that are typically thought of as annoying by hearing aid wearers, e.g., running water, frying. Thus, an added benefit of this technique is that it can be used for sustained, steady-state noise detection as well as transient detection.

According to various embodiments, there are alternate approaches to updating the filter, instead of using NLMS that include more sophisticated adaptive filters and auto-regression models. The present subject matter provides a technique for transient suppression that improves upon previous techniques for differentiating between noise transients (which would be suppressed) and speech transients (which would be maintained). Proper suppression of noise transients decreases annoyance of environmental transient noises currently experienced by hearing-aid wearers. Another benefit of the present subject matter is that it can help identify other (sustained) annoying noises that can be attenuated or handled appropriately. In addition, the predictive signal model of the present subject matter allows transients to be detected with little delay, unlike standard envelope methods that have a sluggishness due to the inertia of envelope calculation.

Hearing assistance devices typically include at least one enclosure or housing, a microphone, hearing assistance device electronics including processing electronics, and a speaker or "receiver." Hearing assistance devices can include a power source, such as a battery. In various embodiments, the battery is rechargeable. In various embodiments multiple energy sources are employed. It is understood that in various embodiments the microphone is optional. It is understood that in various embodiments the receiver is optional. It is understood that variations in communications protocols, antenna configurations, and combinations of components can be employed without departing from the scope of the present subject matter. Antenna configurations can vary and can be included within an enclosure for the electronics or be external to an enclosure for the electronics. Thus, the examples set forth herein are intended to be demonstrative and not a limiting or exhaustive depiction of variations.

It is understood that digital hearing assistance devices include a processor. In digital hearing assistance devices with a processor, programmable gains can be employed to adjust the hearing assistance device output to a wearer's particular hearing impairment. The processor can be a digital signal processor (DSP), microprocessor, microcontroller, other digital logic, or combinations thereof. The processing can be done by a single processor, or can be distributed over different devices. The processing of signals referenced in this application can be performed using the processor or over different devices. Processing can be done in the digital domain, the analog domain, or combinations thereof. Processing can be done using subband processing techniques. Processing can be done using frequency domain or time domain approaches. Some processing can involve both frequency and time domain aspects. For brevity, in some examples drawings can omit certain blocks that perform frequency synthesis, frequency analysis, analog-to-digital conversion, digital-to-analog conversion, amplification, buffering, and certain types of filtering and processing. In various embodiments of the present subject matter the processor is adapted to perform instructions stored in one or more memories, which can or cannot be explicitly shown. Various types of memory can be used, including volatile and nonvolatile forms of memory. In various embodiments, the processor or other processing devices execute instructions to perform a number of signal processing tasks. Such embodiments can include analog components in communication with the processor to perform signal processing tasks, such as sound reception by a microphone, or playing of sound using a receiver (i.e., in applications where such transducers are used). In various embodiments of the present subject matter, different realizations of the block diagrams, circuits, and processes set forth herein can be created by one of skill in the art without departing from the scope of the present subject matter.

It is further understood that different hearing assistance devices can embody the present subject matter without departing from the scope of the present disclosure. The devices depicted in the figures are intended to demonstrate the subject matter, but not necessarily in a limited, exhaustive, or exclusive sense. It is also understood that the present subject matter can be used with a device designed for use in the right ear or the left ear or both ears of the wearer.

The present subject matter is demonstrated for hearing assistance devices, including hearing assistance devices, including but not limited to, behind-the-ear (BTE), in-the-ear (ITE), in-the-canal (ITC), receiver-in-canal (RIC), invisible-in-canal (IIC) or completely-in-the-canal (CIC) type hearing assistance devices. It is understood that behind-the-ear type hearing assistance devices can include devices that reside substantially behind the ear or over the ear. Such devices can include hearing assistance devices with receivers associated with the electronics portion of the behind-the-ear device, or hearing assistance devices of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices. The present subject matter can also be used in deep insertion devices having a transducer, such as a receiver or microphone. The present subject matter can be used in devices whether such devices are standard or custom fit and whether they provide an open or an occlusive design. It is understood that other hearing assistance devices not expressly stated herein can be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method of operating a hearing assistance device, the method comprising:

receiving an audio signal using a microphone of the hearing assistance device;

identifying and isolating a transient in the audio signal using at least a calculated dynamic threshold value and a pre-set threshold value;

using linear predictive coding (LPC) to isolate speech segments and non-speech segments of the transient in the audio signal; and attenuating the non-speech segments of the transient to reduce annoyance of noise and maintain audibility of perceptually important transients in speech, wherein the calculated dynamic threshold value and the pre-set threshold value are used to set attenuation gain value.

2. The method of claim 1, wherein using LPC includes using an adaptive normalized least means squares (NLMS) filter.

3. The method of claim 1, comprising determining a prediction error magnitude.

4. The method of claim 3, comprising applying a linear finite impulse response (FIR) filter using past samples to predict a value of a current sample.

5. The method of claim 3, comprising computing an exponentially smoothed average based on the prediction error magnitude.

6. The method of claim 1, comprising performing a dynamic threshold calculation.

7. The method of claim 6, comprising making a detection decision based on the calculated dynamic threshold and a pre-set threshold value.

8. The method of claim 7, comprising setting attenuation gain value based on instantaneous values of prediction error magnitude, current gain, the pre-set threshold value, and the calculated dynamic threshold.

9. The method of claim 7, comprising making a detection decision based on the calculated dynamic threshold and multiple pre-set threshold values.

10. The method of claim 1, comprising using a sample-and-delay peak tracker for transient detection.

11. The method of claim 1, further comprising identifying the transient in the audio signal.

12. A hearing assistance device, comprising:

a microphone configured to receive audio signals; and a processor configured to process the audio signals to correct for a hearing impairment of a wearer, the processor further configured to:

identify and isolate a transient in the audio signal using at least a calculated dynamic threshold value and a pre-set threshold value;

use linear predictive coding (LPC) to isolate speech segments and non-speech segments of the transient in the audio signal; and attenuate the non-speech segments of the transient to reduce annoyance of noise and maintain audibility of perceptually important transients in speech, wherein the calculated dynamic threshold value and the pre-set threshold value are used to set attenuation gain value.

13. The hearing assistance device of claim 12, wherein the hearing assistance device is a hearing aid.

14. The hearing assistance device of claim 13, wherein the heating aid is a behind-the-ear (BTE) hearing aid.

15. The hearing assistance device of claim 13, wherein the hearing aid is an in-the-ear (ITE) hearing aid.

16. The hearing assistance device of claim 13, wherein the hearing aid is an in-the-canal (ITC) hearing aid.

17. The hearing assistance device of claim 13, wherein the hearing aid is a completely-in-the-canal (CIC) hearing aid.

18. The hearing assistance device of claim 13, wherein the hearing aid is a receiver-in-canal (RIC) hearing aid.

19. The hearing assistance device of claim 13, wherein the hearing aid is a receiver-in-the-ear (RITE) hearing aid.

20. The hearing assistance device of claim 13, wherein the hearing aid is an invisible-in-canal (IIC) hearing aid.

* * * * *